United States Patent [19]

Eskeli

[11] 4,005,587

[45] Feb. 1, 1977

[54] ROTARY HEAT EXCHANGER WITH COOLING AND REGENERATION

[76] Inventor: Michael Eskeli, 7994-41 Locke Lee, Houston, Tex. 77042

[22] Filed: Oct. 1, 1975

[21] Appl. No.: 618,456

Related U.S. Application Data

[63] Continuation-in-part of Ser. No. 474,729, May 30, 1974, and a continuation-in-part of Ser. No. 393,571, Aug. 31, 1973, Pat. No. 3,972,203.

[52] U.S. Cl. ..... 62/401; 60/682; 62/86; 62/499; 165/88; 165/140; 415/178

[51] Int. Cl.[2] ..... F25B 3/00

[58] Field of Search ..... 415/1, 64, 178; 165/61, 165/88, 140; 416/96; 60/327, 682; 62/86, 401; 122/26; 126/247

[56] References Cited

UNITED STATES PATENTS

| | | | |
|---|---|---|---|
| 2,522,781 | 9/1950 | Exner | 165/86 |
| 2,529,765 | 11/1950 | Exner | 165/86 |
| 3,834,179 | 9/1974 | Eskeli | 62/401 |
| 3,933,008 | 1/1976 | Eskeli | 62/401 |
| 3,949,557 | 4/1976 | Eskeli | 60/682 |

*Primary Examiner*—C. J. Husar
*Assistant Examiner*—Sheldon Richter

[57] ABSTRACT

A method and apparatus for transport of heat from a low temperature heat source into a higher temperature heated sink, using a compressible working fluid compressed by centrifugal force within a rotating rotor with an accompanying temperature increase. Heat is transferred from the heated working fluid into the heat sink at higher temperature, and heat is added into the working fluid after expansion and cooling from a colder heat source. Cooling is provided within the rotor to control the working fluid density, to assist working fluid circulation. The rotor has outward and inward extending working fluid passages for circulation therein, and heat is provided by a heat source fluid within its own heat exchanger, and heat is delivered into a heated fluid circulating within its own heat exchanger. Cooling is provided by circulating a cooling fluid within its own heat exchanger; alternately, the heated fluid may also serve as the cooling fluid if desired, before being heated. A regenerative heat exchanger is also provided exchanging heat between two streams of the working fluid within the rotor.

6 Claims, 4 Drawing Figures

ROTARY HEAT EXCHANGER WITH COOLING AND REGENERATION

This application is a continuation-in-part application of "Rotary Heat Exchanger with Cooling", filed May 30, 1974, Ser. No. 474,729 and "Rotary Heat Exchanger", filed Aug. 31, 1973, Ser. No. 393,571 now U.S. Pat. No. 3,972,203.

BACKGROUND OF THE INVENTION

This invention relates to devices for producing heating, wherein a fluid releases heat and another fluid gains heat.

The art of generating heat has seen a variety of devices, using the compression of a gas with temperature increase, and subsequent condensing of the fluid, as the means for providing the heat. These devices are inefficient in that they require large amounts of work for their operation.

SUMMARY OF THE INVENTION

It is an object of this invention to provide means for transferring heat from a lower temperature to a higher temperature wherein a working fluid is compressed with a temperature increase within a rotating rotor, with heat supplied into the working fluid from a heat source that is at a lower temperature than the heat delivery temperature, and where a coolant is also used within the rotor for working fluid density control purposes, and wherein the rotor is provided with a regenerative type heat exchanger to exchange heat between two streams of the working fluid within the rotor.

DESCRIPTION OF PREFERRED EMBODIMENTS

The apparatus described in this disclosure is similar to that described in Patent application "Rotary Heat Exchanger with Cooling", filed May 30, 1974, Ser. No. 474,729; except that the regenerative heat exchanger is being added and some other details are being added.

Figure 1:
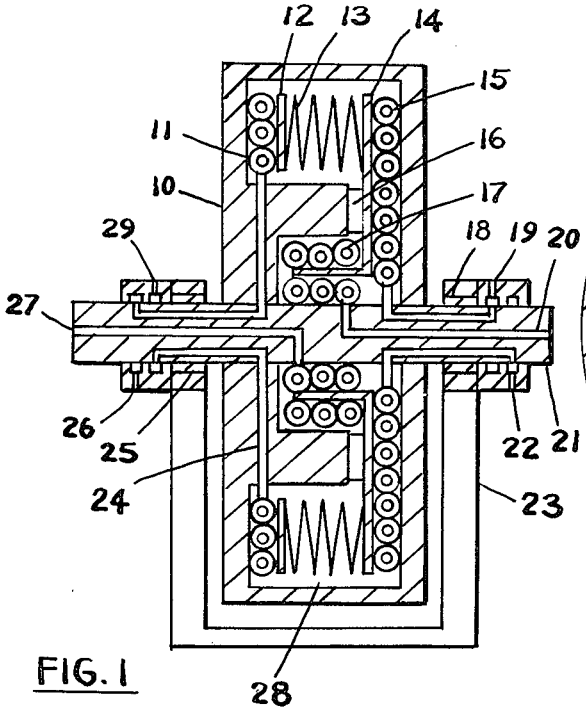
FIG. 1 is an axial cross section of a rotor.

Referring to FIG. 1, therein is shown an axial cross section of a rotor 10, mounted on shaft 21, and supported by bearings 18 and 25, and base 23. The rotor 10 supports heat delivery heat exchanger 11, regenerative heat exchanger 13, heat supply heat exchanger 15 and cooling heat exchanger 17. 12 and 14 are dividers, 16 are vanes, 19 and 22 are heat supply fluid entry and exit, 20 and 27 are cooling fluid entry and exit, 28 is working fluid passage, 24 is heated fluid conduit, 26 and 29 are heated fluid entry and exit.

Figure 2:
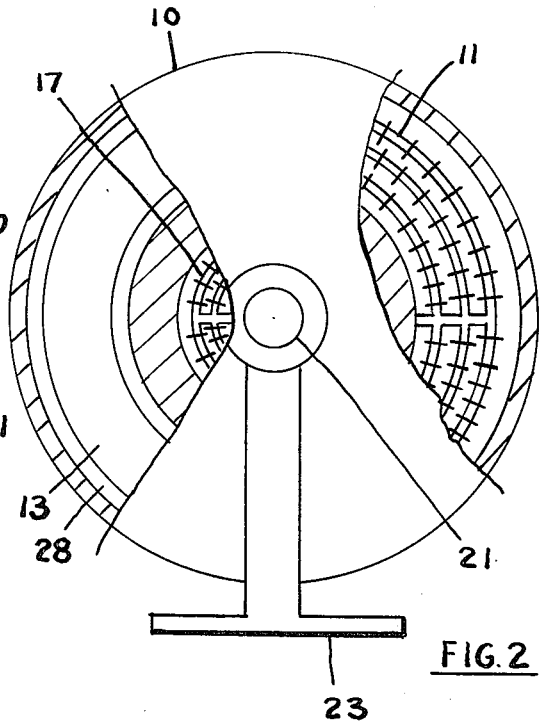
FIG. 2 is an end view of the same rotor.

In FIG. 2, an end view of the unit shown in FIG. 1 is illustrated. 10 is rotor, 11 is heat delivery heat exchanger, 21 is shaft, 23 is base, 28 is working fluid passage, 13 is regenerative heat exchanger, and 17 is cooling heat exchanger.

Figure 3:
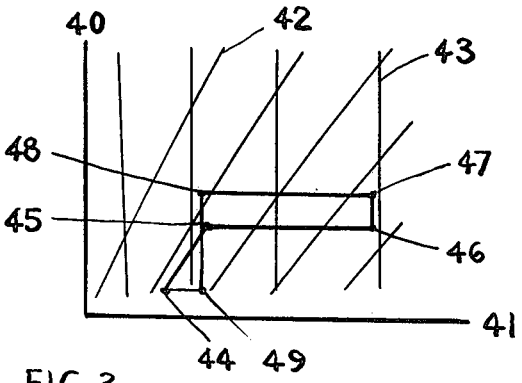
FIG. 3 is a typical pressure-enthalpy diagram for the working fluid circulating within the rotor.

In FIG. 3, a pressure-enthalpy diagram for a typical working fluid is illustrated. 40 is pressure line and 41 is enthalpy line. 42 is constant entropy line and 43 is constant temperature line. The fluid is compressed from 44 to 45 and then heated from 45 to 46 by heat from the same fluid which is cooled from 47 and 48; with compression and heat removal from 46 to 47. Expansion of the fluid is from 48 to 49 with heat addition, and the fluid is then cooled from 49 to 44. Heat is delivered from 46 to 47, and heat is received from 48 to 49.

Figure 4:
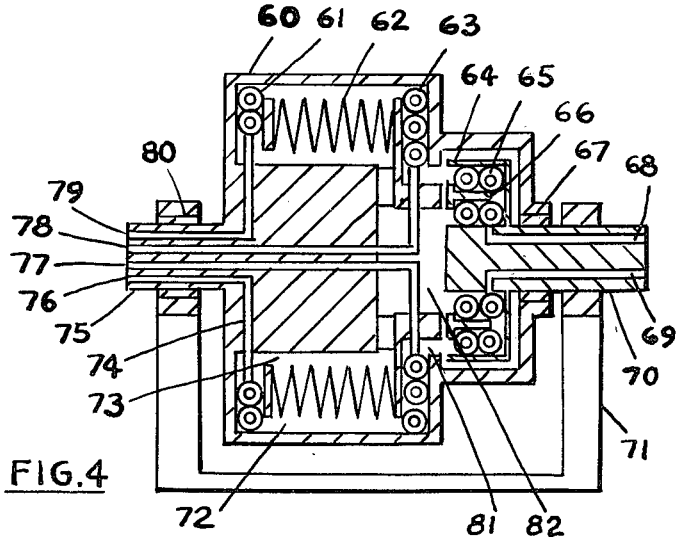
FIG. 4 is an axial cross section of another rotor where one of the heat exchangers used is stationary.

In FIG. 4, another cross section of another rotor is shown, where the cooling heat exchanger is kept stationary. 60 is rotor, 61 is heat delivery heat exchanger, 62 is regenerative heat exchanger, 63 is heat supply heat exchanger, 64 is baffle and part of stationary heat exchanger 65, 66 is another baffle, 67 is bearing and seal, 68 is coolant passage, 69 is another coolant passage, 70 is stationary shaft, 71 is base, 72 is working fluid passage, 73 is working fluid passage, 74 is heated fluid conduit, 75 is rotor shaft, 76 and 79 are heated fluid passages, 77 and 78 are heat source fluid passages, and 80 is bearing. 81 and 82 are working fluid passages.

In operation, the rotor is caused to rotate, and is filled with a suitable working fluid. Heated fluid and heat source fluid are circulated from external sources. The working fluid is compressed by centrifugal force in the rotor internal outward extending passages and during and after such compression heat is removed from the working fluid in heat exchanger 11 into the fluid to be heated. After this, the working fluid passes along passages 28 and delivers heat into another stream of the working fluid in heat exchanger 13, and then the working fluid is expanded with temperature decrease, and during and after such expansion heat is added into the working fluid from a heat source fluid in heat exchanger 15. After this, the working fluid is cooled in heat exchanger 17 to increase the working fluid density to obtain working fluid circulation within the rotor; this densityincreases the weight of the working fluid within the compression side of the rotor assist or to provide for circulation. Thus, heat is provided into the working fluid by heat source fluid, and heat is delivered by the working fluid at a higher temperature into the heated fluid. The regenerator heat exchanger makes it possible to maintain relatively moderate rotor speeds while still having a relatively high temperature in the heat delivery heat exchanger.

The regenerative heat exchanger was described and shown in several copending patent applications: "Turbine", filed Apr. 9, 1975, Ser. No. 566,373; and "Heat Pump", filed Dec. 18, 1974, Ser. No. 533,983. The various forms of the heat exchanger shown in the previous patent applications for the regenerative heat exchanger can be also used with the heat pump with cooling of this invention. Similarly, the heat exchanger of FIG. 3, of patent application "Heat Exchanger", filed July 14, 1975, Ser. No. 595,389, can be used with the unit of this invention.

The heat exchangers 11 and 15 and 17 are shown to be made of finned tubing with a fluid circulated within the tubes. Other types of heat exchangers may be used, as desired, especially if the fluids circulated within the heat exchangers are gaseous.

The working fluid is normally a gas, and the heated fluid and the heat source fluid and the coolant may be either gases or liquids.

Vanes may be employed in the various working fluid passages as required to prevent tangential movement of the working fluid. Alternatively, such vanes may be curved or their radial lengths adjusted to provide for controlled tangential movement for the working fluid;

such adjustments may be used to assist in the circulation of the working fluid.

In the rotor of the apparatus disclosed herein, the working fluid circulation is assured mainly or solely by density control of the working fluid within rotor passages, as indicated in FIG. 3. Where the temperature of available heat source is not suited for obtaining circulation by density control alone, work may be added into the working fluid from the rotor by manipulating the curvature or radial length of the radial working fluid passages within the rotor. Where the temperature of the heat source fluid is sufficient, and other temperatures suitable, then the working fluid is circulated by density control alone, and the working fluid will rotate with the rotor in all areas of the rotor, and also, for such conditions, the work input to the rotor shaft is that which is required to rotate the rotor against friction losses. Also, during such operating conditions, part of the heat supplied by the heat source fluid is passed into the heated fluid, and a part is passed into the coolant.

The use of the regenerative heat exchanger allows the rotor speed to be reduced, while providing a means for high heat delivery temperatures. However, the rotor can be rotated at high speeds, and for such applications, the rotor is usually encased within a vacuum jacket to reduce and eliminate fluid friction losses on rotor external surfaces.

Various regulators and controls are used with the device of this invention. They do not form a part of this invention and are not further described herein.

In FIG. 3, it is shown that the working fluid pressure is constant, normally, from 49 to 44, and in FIG. 4, the cooling heat exchanger portion is stationary with a constant pressure therein. Thus, it should be obvious, that the cooling heat exchanger could be deleted, and the working fluid passed from the rotor to space outside rotor, if desired, with the working fluid leaving the rotor downstream of heat exchanger 63, via opening 81, and then entering the rotor via opening 82. In this manner, the heat exchanger 65 is eliminated, with cooling done outside rotor. Alternately, ambient air then could be used as the working fluid. Similar rearranging could be also carried out for the unit shown in FIG. 1. Further, backward oriented nozzles can be installed in opening 81, to recover work from departing working fluid, as shown in my co-pending patent application "Heat Exchanger", Ser. No. 423,560, abandoned filed Dec. 10, 1973. In deleting the heat exchanger 65, items 64, 66, 67, 68, 69 and 70 are also deleted, as well as the rotor extension surrounding heat exchanger 65.

I claim:

1. In a rotary heat exchanger wherein a compressible working fluid is circulated within a rotor outwardly in a first passage and inwardly toward center of rotation in a second passage, with the inward ends and outward ends of said passages connected by passage means to allow the circulation of said working fluid, and wherein a heat delivery heat exchanger is provided to remove heat from the working fluid during and after compression, and a heat source heat exchanger is provided to add heat into the working fluid during and after expansion, the improvement comprising:

a. a regenerative heat exchanger provided to exchange heat between two streams of the working fluid, with the working fluid stream leaving said heat delivery heat exchanger being in heat exchange relationship with the working fluid stream entering said heat delivery heat exchanger and being upstream of said heat delivery heat exchanger, and wherein a cooling means is provided to remove heat from said working fluid downstream of said heat source heat exchanger.

2. The rotary heat exchanger of claim 1 wherein said heat delivery heat exchanger is provided with a heated fluid circulated within said heat delivery heat exchanger.

3. The rotary heat exchanger of claim 1 wherein said heat source heat exchanger is provided with a heat source fluid circulated within said heat source heat exchanger.

4. The rotary heat exchanger of claim 1 wherein said cooling means comprises a stationary cooling heat exchanger for removal of heat from said working fluid, into a coolant circulated within said cooling heat exchanger.

5. The rotary heat exchanger of claim 1 wherein said cooling means is a cooling heat exchanger carried by said rotor for removal of heat from said working fluid.

6. The rotary heat exchanger of claim 1 wherein said heat source heat exchanger is provided with a heat source fluid circulated within said heat source heat exchanger and wherein said heat source fluid is a gas at least when entering said heat source heat exchanger entry passages.

* * * * *